United States Patent [19]

Heimala et al.

[11] Patent Number: 4,561,970

[45] Date of Patent: Dec. 31, 1985

[54] PROCESS FOR THE FROTH FLOTATION OF COMPLEX METAL COMPOUNDS

[75] Inventors: Seppo O. Heimala, Pori; Kaarlo M. J. Saari, Vanha-Ulvila, both of Finland

[73] Assignee: Outokumpu Oy, Outokumpu, Finland

[21] Appl. No.: 545,510

[22] Filed: Oct. 26, 1983

[30] Foreign Application Priority Data

Nov. 2, 1982 [FI] Finland ..... 823737

[51] Int. Cl.[4] ..... B03B 1/00

[52] U.S. Cl. ..... 209/3; 209/166; 75/2

[58] Field of Search ..... 209/1, 2, 3, 9, 162, 209/163–171; 75/2

[56] References Cited

U.S. PATENT DOCUMENTS

| | | | |
|---|---|---|---|
| 1,733,570 | 10/1929 | Wilson | 209/167 |
| 1,893,517 | 1/1933 | Gaudin | 209/167 |
| 3,339,730 | 9/1957 | Boutin et al. | 209/168 |
| 3,711,032 | 1/1973 | Weston | 209/166 |
| 3,883,421 | 5/1975 | Cutling et al. | 209/1 |
| 3,932,271 | 1/1976 | Nagano et al. | 209/167 |
| 3,933,625 | 1/1976 | Nagano et al. | 209/167 |
| 4,211,644 | 7/1980 | Wiechens | 209/166 |

FOREIGN PATENT DOCUMENTS

| | | | |
|---|---|---|---|
| 903935 | 6/1972 | Canada | 209/166 |
| 362961 | 12/1931 | United Kingdom | 209/166 |

*Primary Examiner*—Bernard Nozick

[57] ABSTRACT

The invention relates to a process for the froth flotation of complex ores. In accordance with this invention, froth flotation is carried out by using a collector and froth flotation conditions for which it has been calculated in advance that the said mineral and the collector form stable surface compounds. The conditions include the electrochemical potential of the system, the concentration of the collector, the pH, and other physical factors. According to this invention it has been observed that by adjusting the potential and the concentration of the collector separately for each mineral, each mineral can be frothed out separately from the slurry, the process being in this case specific for the mineral. When so desired, the different minerals of the ore slurry can also be frothed simultaneously by selecting the conditions where the Pourfaix-type diagrams of all minerals in said complex ore overlap under the conditions in question.

8 Claims, 8 Drawing Figures

PROCESS FOR THE FROTH FLOTATION OF COMPLEX METAL COMPOUNDS

BACKGROUND OF THE INVENTION

The present invention relates to a process for the froth flotation of complex metal compounds. What is in question is in particular an ore-dressing process by means of a collector and a frother in which electrochemical control of the flotation conditions creates optimum conditions for the flotation.

In general, froth flotation is carried out using a collector which should be specific as regards the mineral being frothed in order that the result of the froth flotation be optimal. By means of the collector the mineral is caused to adhere to air bubbles and to rise to the surface of the material being treated by froth flotation. It has been presented that adherence to the surface of the desired mineral is affected by the relative wettability of the surfaces of the various minerals. The free energy of the surface is often intentionally reduced by adding, for example, heteropolar surface-active agents.

Collectors which collect only a certain mineral from among several other minerals are very difficult to find, especially when high demands of effectiveness are also set on the collector. The composition of the mineral varies continually and, on the other hand, the surface properties of many different minerals greatly resemble each other. The mineral formation environments, etc., for their part affect the properties of minerals, and so the behavior of the collector is not easy to predict. Usually it is necessary to settle for compromises as regards specificity and effectiveness, and the separation conditions must be created by means of regulating reagents and pH changes.

Endeavours have been made to improve in several ways the predictability of the behavior of collectors. New collectors have been developed, and attempts have been made to improve the effectiveness of the collector agent by oxidizing the agent electrochemically during the treatment of the ore slurry, and on the other hand, attempts have been made to affect the properties of the ore by reducing the oxidized ore by means of an electric current during the pre-treatment of the ore.

Furthermore, U.S. Pat. No. 3,883,421 to cutting et al discloses a method for the froth flotation of ore and for the recovery of the valuable products present in it by maintaining the redox potential measured from the flotation cell at a certain predetermined value. The value is influenced by adjusting the quantity of the chemicals such as sulfide and xanthate fed into the cell, as the potential measured tends to change from the predetermined value.

However, no advantage is gained by the method in question in the case of complex ore, since if a certain redox potential is selected in advance and the collector, and perhaps also other chemicals, is added, the collector adheres to the surface of one as well as another mineral, because in the control of the potential it is necessary to pass through a range within which the surface compounds of both minerals to be separated and the collector are stable. A stable compound does not easily leave the surface and, in addition, it is easily stabilized by the frother and the oxidized form of the collector. In the method in question of said patent direct measuring of the concentration of collector in the slurry is not used, and for this reason oxidized, poorly soluble forms of the collector are always formed during the control of the potential in question. Since the redox potential is measured in the method, which means unselective measurement by means of, for example, a Pt electrode, and since the collector concentration control is carried out by observing the quality of the concentrate, the variation in the concentration of collector is very high, which for its part results in an ample presence of oxidized forms of the collector, such as dixanthagen, and a poor flotation outcome.

The object of the present invention is to provide a process by means of which the separation is really optimized and by means of which different valuable constituents can be separated, each separately, or by means of which it is possible in most cases to recover all minerals from the ore by joint froth flotation, if so desired. Furthermore, by means of the process according to the invention it is simple to prevent the formation of compounds which have a disadvantageous effect on the separation process. This is all achieved by the process the main characteristics of this invention which are given in the accompanying claims.

SUMMARY OF THE INVENTION

The basic idea of the invention is that it has been observed that the collector adheres to the mineral surface completely according to natural laws which can be verified by electrochemical methods. The collector can be caused to adhere to a mineral surface and again to leave it by changing the electrochemical potential of the system and/or by changing the concentration of the collector, in addition to which the situation is also affected by the pH of the froth flotation solution. In the case of a complex ore the knowledge of the adherence conditions, i.e. the situation in which the collector forms a stable phase with each mineral to be recovered, is important, because by a knowledge of the conditions and by their control each valuable mineral can be separated from the system specifically.

It is possible to calculate on the basis of experiments for each element and for each of its compounds within a potential-(temperature)-pH-$H_2O$ system the a range within which the surface compound formed by the element and the collector agent is stable, i.e. the range within which the separation of the element in question by specific froth flotation is most successful. The principle of such a diagram of the so-called Pourfaix type is presented in FIG. 8.

In terms of the success of the froth flotation the form in which an element is present is not very significant. If the element is present as separate particles, it can be frothed whether it is in the form of a sulfide, oxide, carbonate or silicate, for it is the formation of the above-mentioned stable surface compounds that is decisive in this respect.

In practice the froth flotation of a complex ore containing more than one mineral is carried out in such a way that the potential is initially such that the collector is completely in solution, i.e. the procedure is carried out in general from the cathodic range towards the anodic range. The first froth flotation is carried out in order to recover the first mineral within such a range of potential and collector concentration that the collector adheres to the surface of only the desired mineral and a stable surface compound between the collector and the mineral is formed only on the desired mineral. The second stage of the froth flotation consists of the flotation of the second desired mineral, during which the potential is shifted further towards the anodic side. At this stage the principal mineral to be recovered is a mineral different from that in the first flotation, the surface compounds of that mineral being stable. It is evident that, as a rule, during the second froth flotation, also part of the mineral left unrecovered in the first froth flotation is recovered. It is, of course, possible to carry out one or several further froth flotations, again within a new potentialcollector concentration-(pH) range, whereby again a different mineral is recovered. As will be evident from the description of FIG. 8 below, in most cases it is also possible to carry out a joint froth flotation of the minerals, since the diagrams usually also include a range within which all minerals form stable surface compounds.

It is highly crucial for successful use of the system that the quantity of the collector is precisely known and under control, for which reason the collector concentration control must be precise, selective, and it has to be carried out directly on the slurry.

Through knowledge of the stability of the compounds formed by each element with the collector agent used, it is possible to make use, in a controlled manner, of cementations (e.g. Cu activation), activations or passivations (depressions) carried out using poorly soluble compounds. Raising of the temperature, or some other process technology control system, tends to improve the results obtained by the process, but it must be decided separately for each froth flotation case. It is important that the measuring of the potential and the pH, and preferably also of the collector concentration, is continual during froth flotation. Though the control of the potential can often be carried out by electrochemical control and regulation by mediation of soluble ions, it has been shown that in the most complicated cases direct electrochemical regulation and control of froth flotation conditions is always reliable and successful. One reason for this is that, for example when air is used for the control of the potential, different potentials are produced for different particles (e.g. production of a reduction product $H_2O_2$ and its reactions).

The froth flotation, or at least the pretreatment and preparation, is carried out in an electrolytic cell, in which the conditions are adjusted to those desired at the work electrode. It is usually advisable to place the counterelectrode behind a diaphragm, for example, in order to eliminate disturbances. The structure of the cell itself can be implemented in many ways by linking it, for example, to preparation tanks or froth flotation cells already in use. It has been observed that in complicated cases and also otherwise the conditions required for froth flotation can be achieved in a practical way by combining the now described potential-collector control (pH control) with the ore comminution stages, during which new pure surface is produced. It is important that the slurry to be subjected to froth flotation can come into contact as effectively as possible with the surface of the electrodes, either directly or by mediation of soluble ions. This means that in this case a possible difference in potential between particles remains minimal. The work electrode may be a two- or three-dimensional, generally known type of electrode, such as a net or powder electrode. One alternative used in the experiments was a three-dimensional electrode, for example an electrode of graphite powder, metal powder, etc., in which case the particles making up the electrode were larger than the particles in the slurry to be subjected to the froth flotation. The use of a net electrode is also possible. The material to be subjected to froth flotation can be directed, for example by pumping, via a three-dimensional potential-determining electrode. It is advantageous also to link to this system the control of pH and the collector. Should there not be a sufficient amount of a conductive salt such as $CaSO_4$ in the slurry, it is possible to add, for example alkali or earth alkali salts to the circulating solutions. The process under discussion does provide significantly better possibilities for circulating the process solutions in connection with ore enrichment than do currently known processes.

DESCRIPTION OF THE PREFERRED EMBODIMENTS

Though the method is suitable for all of the above-mentioned ores, the reactions of two sulfides, $Cu_2S$ and $CuFeS_2$, are discussed below in greater detail. When the initial material is $Cu_2S$, then its treatment with potentials negative with regard to $E_h$ causes loss of sulfur ($HS^-$, $H_2S$), whereas oxidation causes the copper to pass into solution or to various compounds on the particle surface. In the presence of a collector at an $E_h$ value dependent on, for example, concentrations, the collector begins to adhere to the particle surface. The sulfur released in the reaction either combines to form $CuS_x$, or under certain conditions forms elemental sulfur or its oxidation product. If the concentration of collector is high or/and the potential rises further, the collector begins to produce a separate phase of its own in the solution, at the same time adhering nonselectively to the surface of, for example, silicates also. As a consequence, the grade of the concentrate becomes lower and the yield possibly decreases, owing to, for example, the formation of flocs too heavy for froth flotation. At higher potentials, outside the stability range of the metal-collector compound, the collector detaches and passes into solution or may form oxidized forms, in which the non-oxidized collector also dissolves. The above provides an explanation for the observation that it is often advantageous to measure the potential of the slurry using as electrodes the same mineral or the same minerals as are subjected to the flotation.

Figure 1:
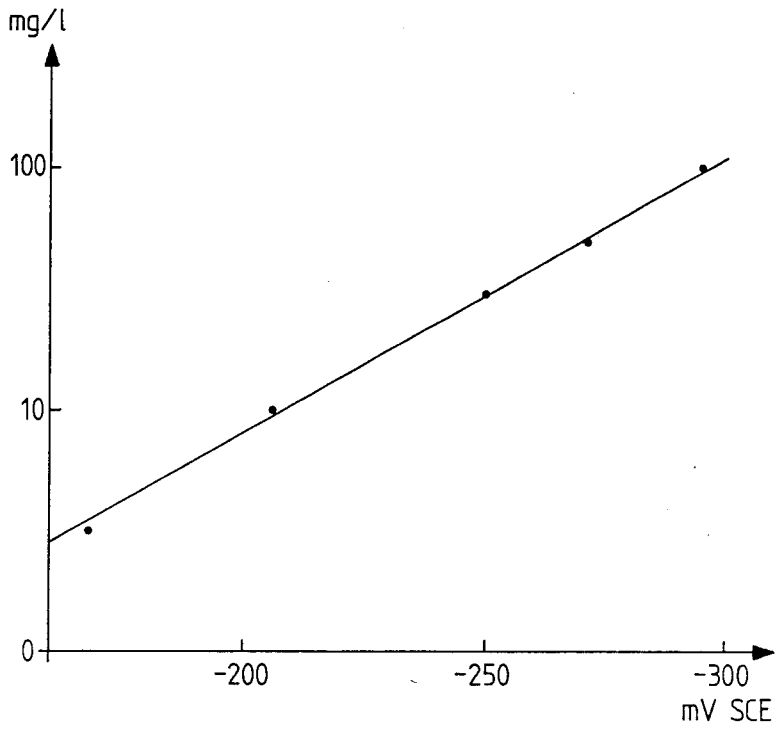
FIG. 1 depicts the potential of the compound $Cu_2S$ at varying concentrations of potassium methyl xanthate, which is used as the collector.

FIG. 1 shows the potential of $Cu_2S$ at varying concentrations of potassium methyl xanthate, which is used as the collector. The other initial material discussed is $CuFeS_2$. In this compound, FeS first reacts in the same manner as $Cu_2S$, and the remaining CuS somewhat later, owing to the fact that sulfide compounds of copper are more stable than those of iron. In this case the yield of the froth flotation is mainly determined by CuS.

The iron may form FeOOH, $Fe(OH)_3$, Fe carbonate, or some other corresponding compound on the particle surface and provide further possibilities for control. When FeS reacts there is formed in part both $S^0$ and other sulfur compounds. Cu sulfide reacts in accordance with the reaction $CuS + KeX \rightarrow CuEX + S^0$. The elemental sulfur produced as the result of the reaction is important for the froth flotation. In an optimum case it is possible to carry out the froth flotation using only frothers and no collector. In such a case, elemental sulfur, which then serves as a collector, is caused to form on the surface of the minerals by means of control of the potential.

The method described above can be used for the treatment of all sulfides, antimonides, tellurides, arsenides, etc. The potential of non-conductive oxide phases is regulated, as that of sulfides, by mediation of soluble ions or electrically, for example by using a three-dimensional powder electrode. Ions suitable for the control include $Fe^{3+}$, $Fe^{2+}$, $V^{2+}$, $V^{3+}$, $Mn^{3+}$, $Mn^{7+}$, $O_2$, $H_2$, $H_2O_2$, $Cr^{2+}$, $Ti^{3+}$, sulfites, phosphites, arsenites, hydrazine, organic oxidants reductants, antimonites, $Sn^{2+}$, $Sn^{4+}$, and solid metal powders, etc. By controlling the quantity of the abovementioned soluble ions, a compound of, for example, the type $RCOO^-Me^+$ is obtained on the surface of the desired phase. Other suitable compounds include those in which the bond is formed, instead of oxygen or in addition to it, by nitrogen (amides, imides). In other respects the process is applied in the same way as is done when dressing sulfide ores. The collector concentration can be determined by means of, for example, a $CuS_x$, $AgS_x$ or $MoS_2$ electrode or some other stable sulfide or oxide electrode directly from the slurry. In terms of the method, the most advantageous case is one in which the froth flotation range is approached from the direction of those conditions in terms of pH, potential, surface phase, etc., which ensure the highest solubility of the collector agent. In practice, this is often the case when the procedure starts from a potential range which is reducing for the system at the moment of the adding of the frothing agent. In accordance with the invention it is possible to flocculate fine particles selectively, whereby there is a controlled shift to a potential range within which the collector oxidizes, thereby forming, for example, dixanthagen. Those particles which already have the collector on their surface adhere to the floc first.

As mentioned above, FIG. 1 depicts the potential of the compound $Cu_2S$ at a varying concentration of potassium methyl xanthate, which is used as the collector. It should be noted that the concentration of xanthate is shown on a logarithmic scale. The horizontal axis is formed by the potential as compared to a standard calomel electrode.

Figure 2:
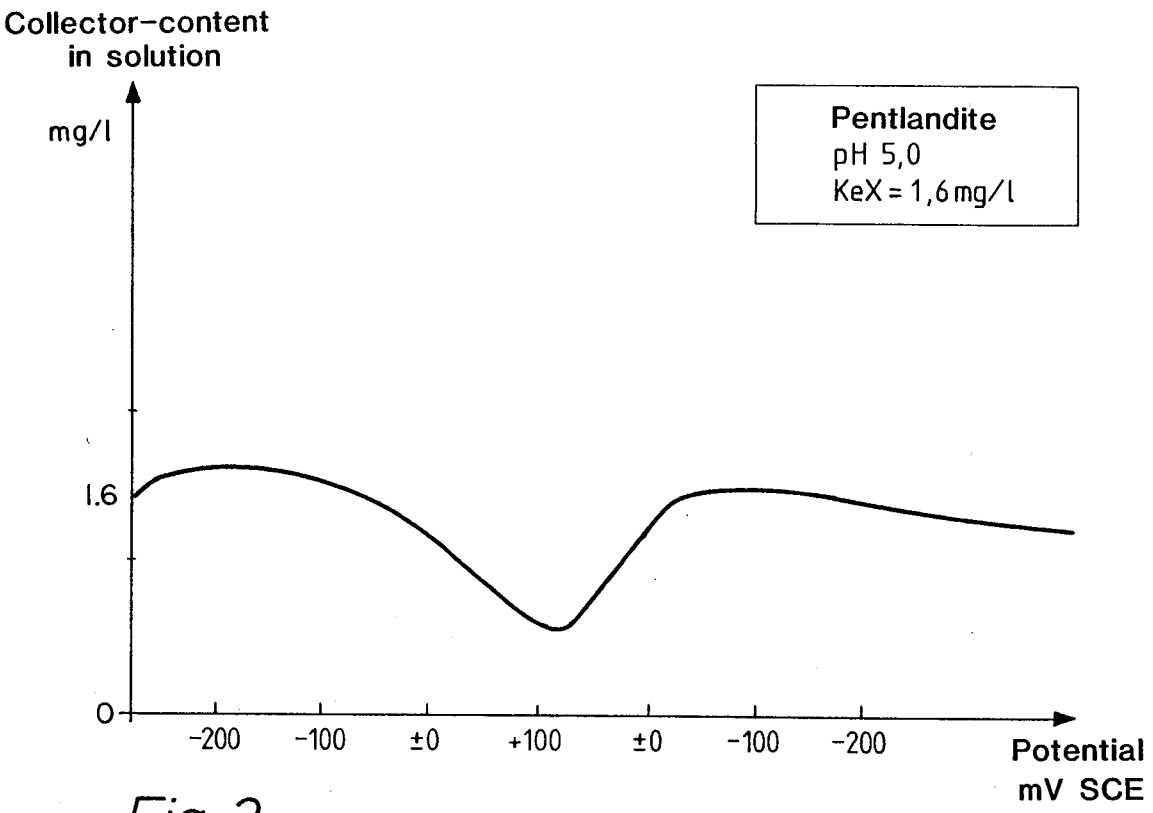
FIG. 2 depicts graphically the adherence of potassium xanthate to the surface of pentlandite at varying values of potential.
Figure 3:
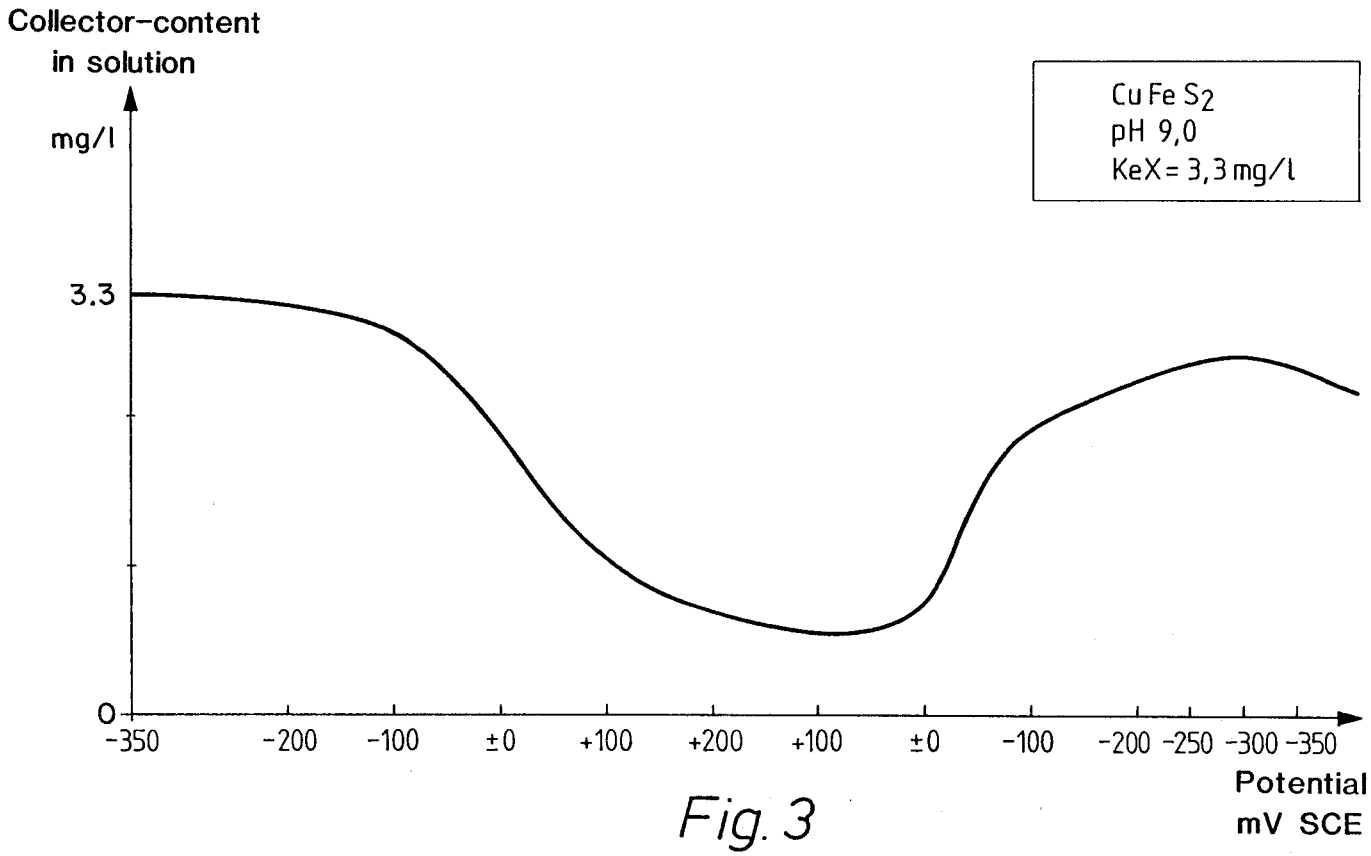
FIG. 3 depicts a curve similar to FIG. 2 for $CuFeS_2$ ore.
Figure 4:
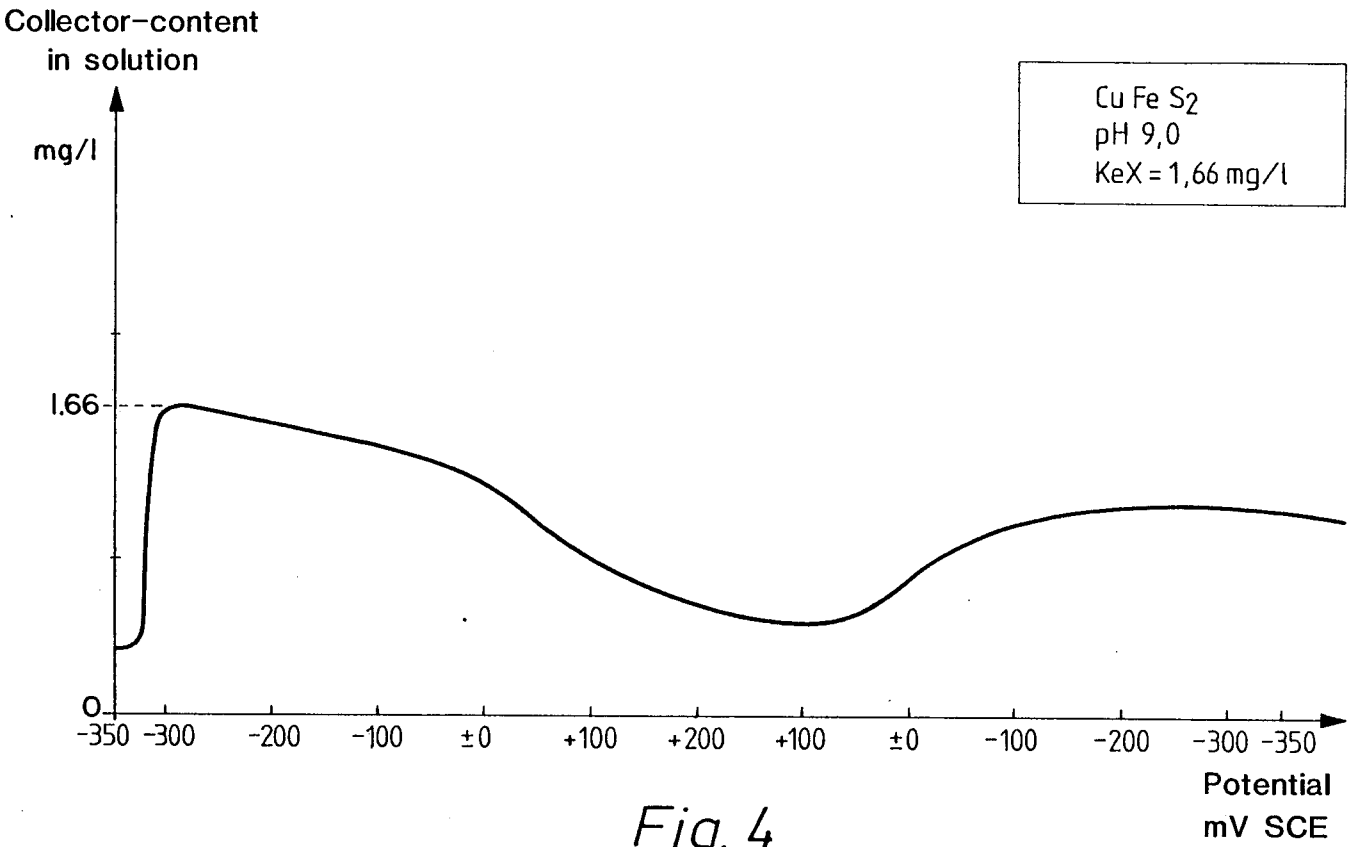
FIG. 4 depicts the curve of FIG. 3 when the collector concentration is one half of that used in FIG. 3.
Figure 5:
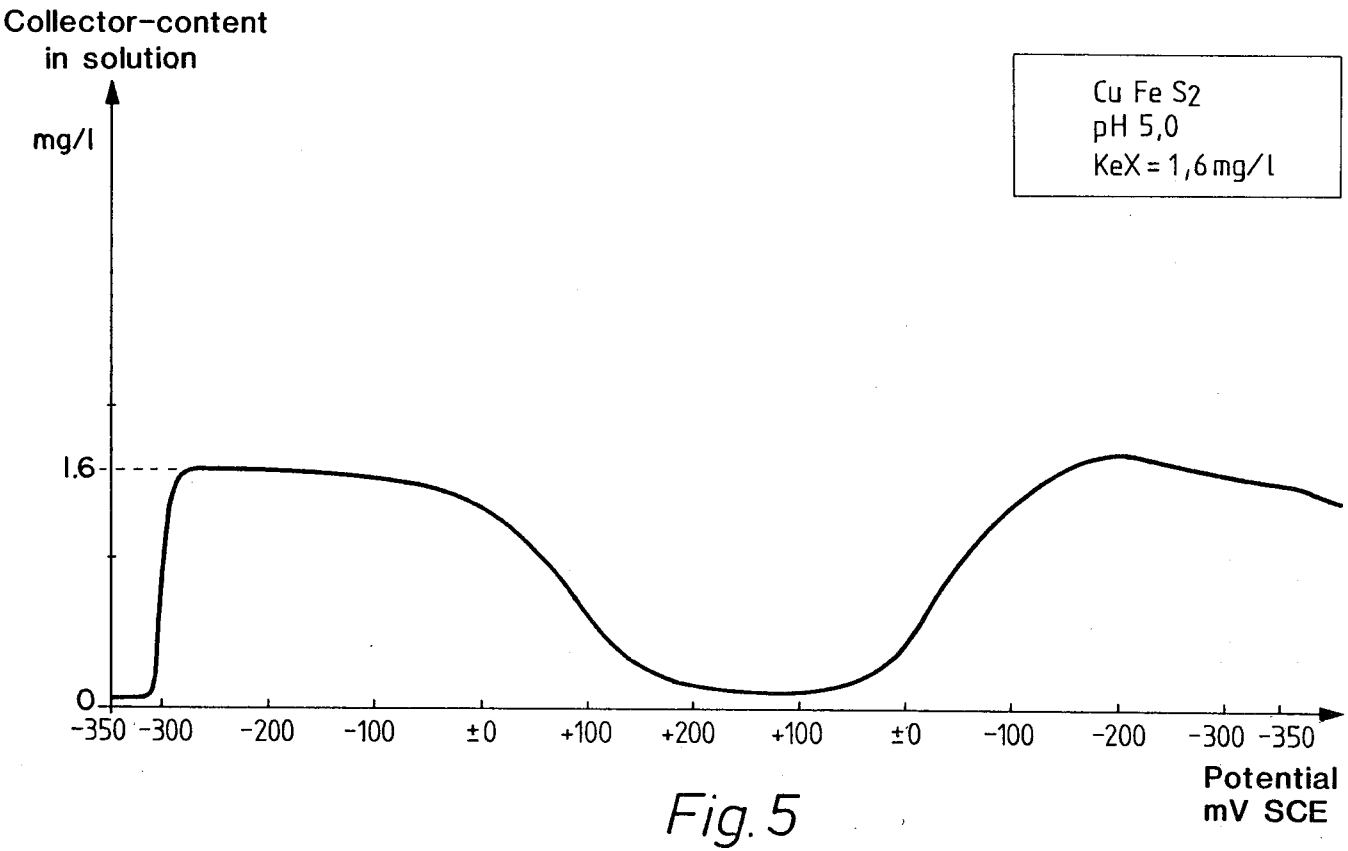
FIG. 5 depicts the curve of FIG. 4, the pH deviating from that in FIG. 4.
Figure 6:
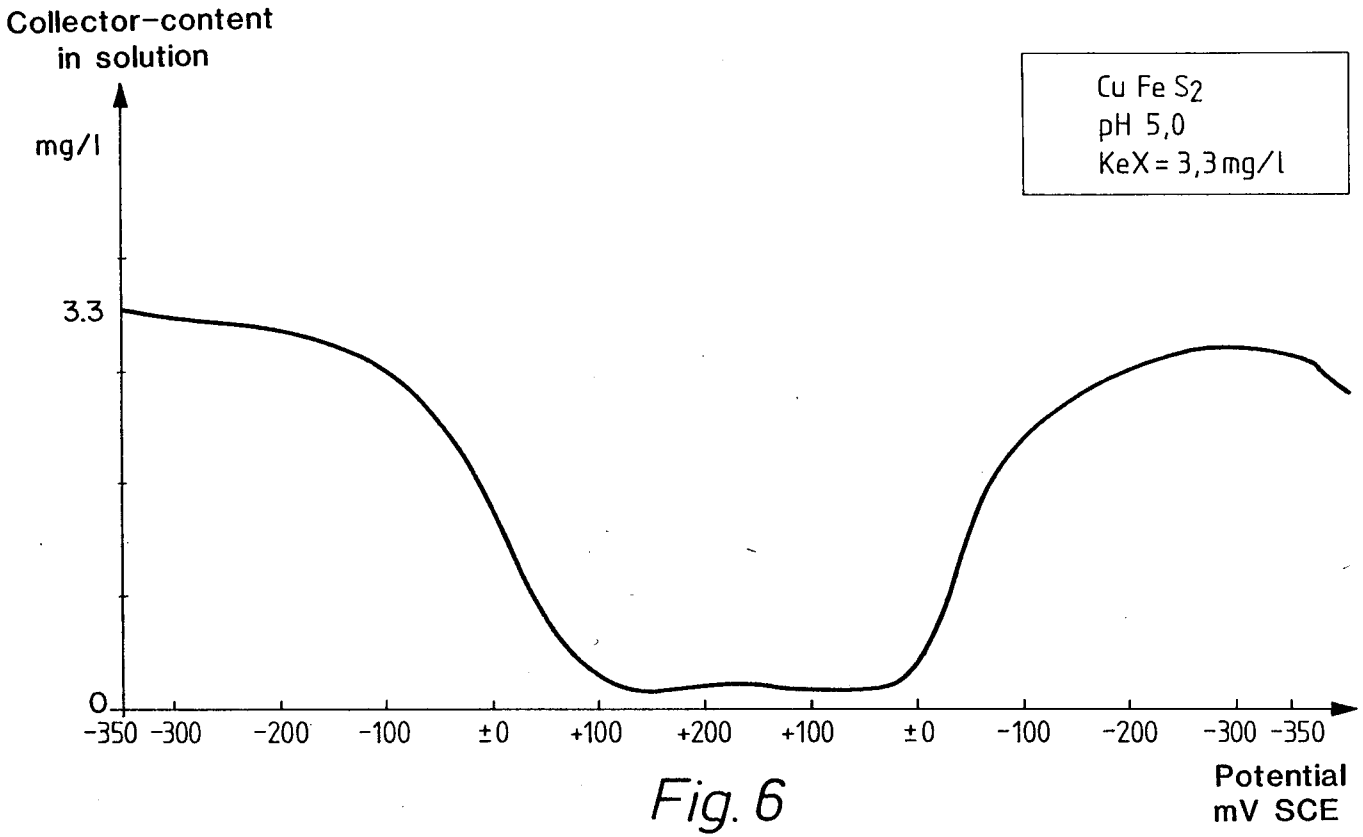
FIG. 6 depicts the curve of FIG. 5, when the collector concentration is doubled as compared with that of FIG. 5.

FIGS. 2–6 depict, in mutually corresponding ways, graphic curves for three different ores, showing the concentration of potassium methyl xanthate in the solution at varying potential. The effects of the collector and pH on the curves are observed in separate figures. The minimum point on the curve means that little free xanthate is present in the solution, i.e. the xanthate has adhered to the mineral surface. In each figure, the potential has been converted linearly 1 mV/s. In FIG. 2 the test mineral is pentlandite (Ni, Co, Fe)$_9S_8$ and in the other figures it is $CuFeS_2$. The pH and the collector concentration of each experiment is indicated in the figure, which also shows that a change in pH or a change in the concentration of collector has an effect on the potential at which the froth flotation occurs under optimum conditions.

Figure 7:
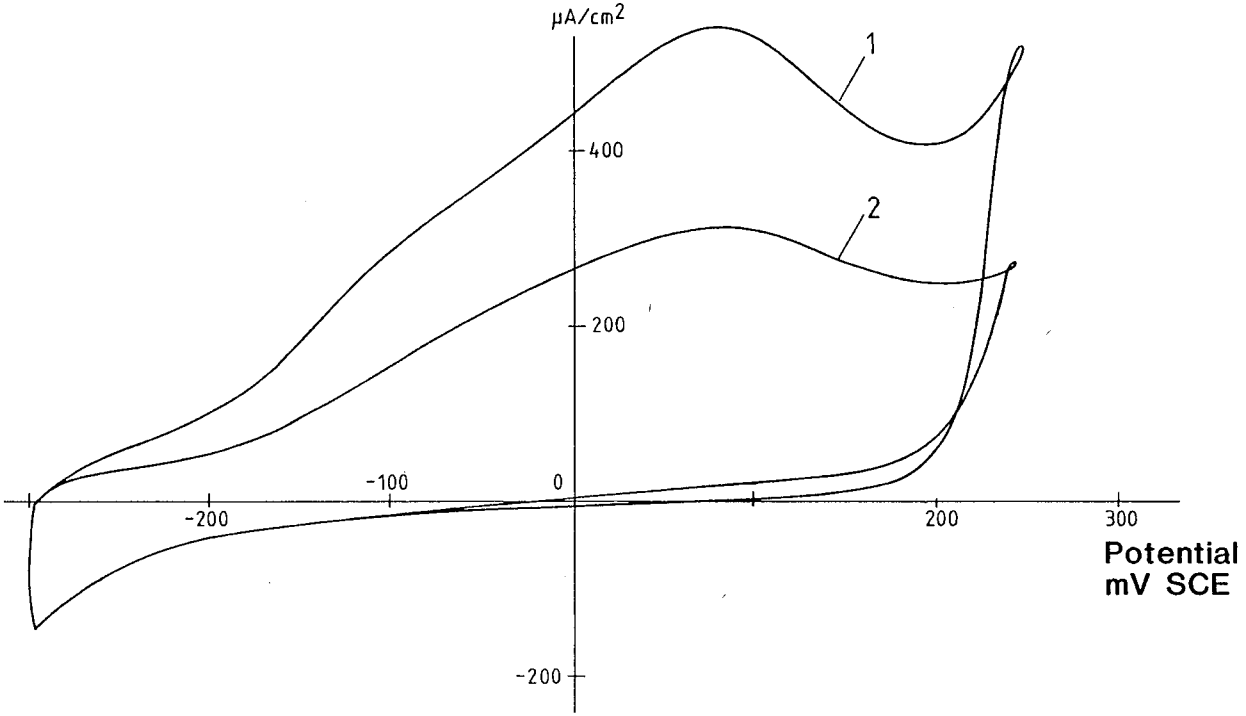
FIG. 7 depicts by means of cyclic current-potential curves the collector-mineral equilibrium for $CuFeS_2$, with no collector present, and with collector present, respectively.

FIG. 7 depicts by means of cyclic current-potential curves the content of FIGS. 2–6, i.e. primarily the behavior of the ore of FIGS. 3–6 at a clearly higher collector concentration. Curve 1 represents an experiment without xanthate and curve 2 an experiment with xanthate. A clear difference between the curves can be seen.

Figure 8:
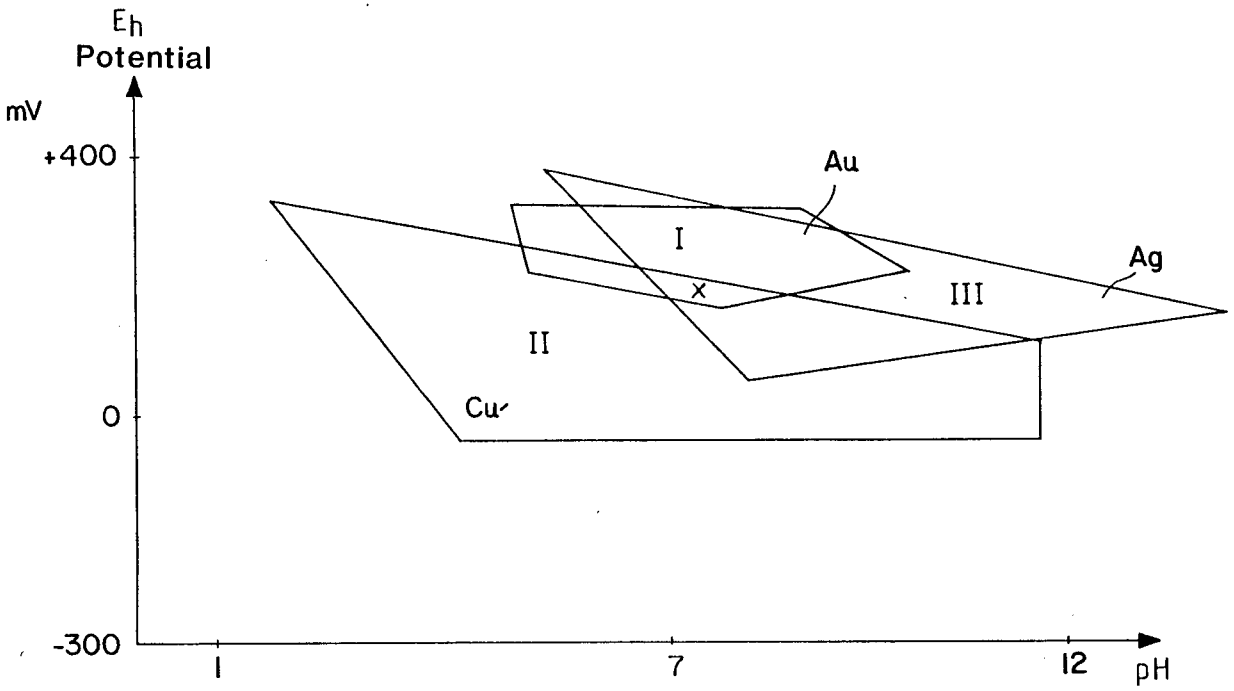
FIG. 8 depicts a Pourfaix-type diagram for three different combinations of a mineral and a collector.

FIG. 8 depicts, as mentioned above, a Pourfaix-type phase diagram, which shows diagrammatically those ranges calculated for each mineral within which its surface compounds formed of the mineral and the collector are stable. In the figure, the cross indicates the point at which joint froth flotation of all the three minerals is possible, and the circles for their part indicate, within the stable area of each mineral, the point at which separate flotation of the mineral out of the complex ore is possible.

EXAMPLE 1

An oxidized Au-Cu-Pb ore was subjected to froth flotation. The minerals to be recovered were gold and its compounds, $Cu_2(CO_3)$, $Cu_2(OH)_2$, $CuFeS_2$, $Cu_9S_5$, CuS, $Cu_5FeS_4$ and chalcocite, as well as PbS and alkaline Pb minerals. $Fe^{3+}$ compounds, such as FeOOH, constituted, in terms of the froth flotation, an important and problematic secondary constituent. The Cu content in the initial material was 0.7% and its gold concentration 5 g/tonne and Pb concentration 0.2%. The collector used in the froth flotation was "Aerophine 3418A", sodium diisobutyldithiophosphinate −50° aqueous solution, and its concentration in the aqueous phase was maintained at 20 mg/l. The control of the potential was carried out by means of sodium sulfide, with the aid of a titrator. At the beginning of the froth flotation, the potential was adjusted to a value which was somewhat below −200 mV, and it was raised at a controlled rate to a value at which the collector did not yet adhere to the surface of the Pb mineral in an amount sufficient for froth flotation. The pH of the slurry was maintained at 8.5. The yield of copper into the first green malachite concentrate was 68%, the concentration of copper in this concentrate being 6.7%. The total yield of copper into the Cu concentrate was 81% and the total yield of Pb into the Cu concentrate was 8%. The concentration of gold in the first concentrate was 38 g/tonne, and its yield was 76%. The total yield into the concentrate was 92%. Thereafter, the potential was raised by 100 mV, and the concentration of collector in the solution of the slurry was raised by 15 mg/l. The total yield of lead into the Pb concentrate was 72% and that of Cu was 9%, the concentration of Pb being 38%. A corresponding experiment was also carried out without control of the collector concentration but with control of the potential. In this case the yield of copper into the first joint concentrate was 31%, and its concentration in it was 3.7%. The total yield of copper was 64% and that of Pb was 58%. The yield of gold into the first concentrate was 48% and its total yield was 70%.

EXAMPLE 2

A froth flotation experiment was carried out on an ore the structure and pure grinding of which cause difficulties in normal froth flotation processes. The material to be subjected to froth flotation was a sulfidic Ni-Cu ore, in which the Ni concentration was 0.45% and the copper concentration 0.2%; the sulfur concentration 1.4%, the MgO concentration 31% and the Fe concentration 9%. It is characteristic of the initial material that, during grinding, mixed particles of $Fe_3O_4$-Ni-sulfide-(pentlandite) are formed and that the Mg silicate comes out very finely divided. Froth flotations according to the state of the art and according to the present method were carried out on the solid material. In each experiment the density of the slurry was 20%. The collector used in both was ethyl xanthate. In the known method the froth flotation time was 3 min. In the experiment according to the present invention the potential from the cathodic side as regards the sulfide was raised first to −50 mV and then to 0 mV vs. SCE in the electrical circuit in such a way that the concentration of xanthate in the solution of the slurry was first 5 mg/l (−50 mV) in the froth flotation of copper and 60 mg/l (0 mV vs.SCE) in the froth flotation of Ni, whereby separate concentrates of Cu and Ni were obtained. In the reference process, neither the potential nor the concentration of the collector in the solution of the slurry was controlled, and in it the yield of Ni into the first joint concentrate was 45% and the total yield 59%, the concentration of nickel being 2.1%; for Cu respectively 52% and 66%. In the experiment according to the present invention the respective yields of Ni after the first and the second Ni froth flotation were 57% and 71% and the concentration of Ni 2.7%, and in the first Cu froth flotation the yield of Cu into the Cu concentrate was 76%. In addition, during the second stage, i.e. in the Ni froth flotation, 12% of the copper passed into the Ni concentrate. Furthermore, by the process according to the invention a considerably lower MgO concentration than in known methods was obtained, especially in repeat operations.

Modern automatic data processing provides excellent possibilities for the automation of the process according to the invention. The froth flotation range can be determined for each mineral with respect to equilibrium, as well as with respect to kinetics. The values for the feed of the froth flotation can be determined separately, and on the basis of data stored in the computer memory it is possible to calculate automatically the control values for the froth flotation, taking into consideration the world market situation, for example the price of the metal being refined and the costs incurred from its further refining.

What is claimed is:

1. A process for the froth flotation of an ore of complex metal compounds and metal compound powders from a mineral ore containing mixtures thereof, concentrating them out from an ore slurry, in which the electrochemical potential controlled, which comprises the steps of determining for each metal compound the electrochemical potential, pH, and temperature range within which the surface compound formed by the metal compound and the collector is stable adjusting the electrochemical potential by electrical, chemical or combined electrical and chemical means, to the froth flotation electrochemical potential within the said range from a direction in which the collector is completely in solution by using as the electrode the metal compound or metal compounds frothed in measuring for the control of the electrochemical potential of the slurry; and carrying out froth flotation on each metal compound in that order in which said potential ranges are in the cathodic to anodic electrochemical potential control direction, and controlling the concentration of the collector by continually measuring the solution electrochemical potential by an electrode selected from the class consisting of $CuS_x$, $AgS_x$ and $MoS_2$ electrodes.

2. The process according to claim 1, in which elemental sulfur, which is produced from the metal sulfide by the electrochemical potential used and which passes to the surface of the metal compound serves as the collector.

3. The process according to claim 1, in which the froth flotation is carried out as a joint froth flotation concentration of all the desired metal compounds present in the slurry, by adjusting the froth flotation conditions to such values that each of the metal compound frothed forms stable surface compounds with said collector within said range.

4. The process according to claim 1, wherein the electrochemical potential is adjusted to a range within which the collector oxidizes, for selective flocculation of fine metal compound particles, which have collector on their surface and adhere to other metal compound particles coated with the collector.

5. The process according to claim 1, comprising the steps of controlling the electrochemical potential by means of an electrical circuit, by adding electrochemical redox potential control reagents, or by a combination thereof.

6. The process according to claim 5, in which the electrochemical potential control reagent is at least one soluble ion selected from the group consisting of $Fe^{3+}$, $Fe^{2+}$, $V^{2+}$, $V^{3+}$, $Mn^{3+}$, $Mn^{7+}$, $O_2$, $H_2$, $H_2O_2$, sulfite, phosphite, arsenite, antimonite, hydrazine, and metals in elemental form.

7. The process according to claim 5, in which the electrochemical potential is controlled using a three-dimensional powder electrode in which case the control is carried out at the comminution stage by grinding the slurry, the surface of which is free owing to the grinding.

8. The process according to claim 7, in which the particle size of the powder electrode is greater than the particle size of the slurry which is pumped via the power electrode.

* * * * *